US011129759B2

(12) United States Patent
Ho

(10) Patent No.: US 11,129,759 B2
(45) Date of Patent: Sep. 28, 2021

(54) STRAP FOR CARRYING HUMAN BODY

(71) Applicant: Yu-Cheng Ho, Tainan (TW)

(72) Inventor: Yu-Cheng Ho, Tainan (TW)

( * ) Notice: Subject to any disclaimer, the term of this patent is extended or adjusted under 35 U.S.C. 154(b) by 141 days.

(21) Appl. No.: 16/547,316

(22) Filed: Aug. 21, 2019

(65) Prior Publication Data

US 2021/0052442 A1 Feb. 25, 2021

(51) Int. Cl.

| | |
|---|---|
| ***A61G 1/013*** | (2006.01) |
| ***A61G 1/048*** | (2006.01) |
| ***A61G 1/044*** | (2006.01) |
| ***A61G 1/04*** | (2006.01) |
| *A61G 7/10* | (2006.01) |

(52) U.S. Cl.

CPC ..... *A61G 1/013* (2013.01); *A61G 1/042* (2016.11); *A61G 1/044* (2013.01); *A61G 1/048* (2013.01); *A61G 7/10* (2013.01); *A61G 7/1013* (2013.01); *A61G 7/1023* (2013.01); *A61G 7/1051* (2013.01); *A61G 7/1053* (2013.01)

(58) Field of Classification Search

CPC ..... A61G 1/013; A61G 1/048; A61G 1/044; A61G 1/042

See application file for complete search history.

(56) References Cited

U.S. PATENT DOCUMENTS 2,788,530 A * 4/1957 Ferguson ..... A61G 1/01 5/628
2,813,745 A * 11/1957 Frieder ..... B66C 1/127 294/77
3,889,668 A * 6/1975 Ochs ..... A61F 5/05883 128/870
3,933,154 A * 1/1976 Cabansag ..... A61F 5/3776 128/870
4,124,908 A * 11/1978 Burns ..... A61F 5/3776 2/69.5
4,159,840 A * 7/1979 Fengels ..... B66C 1/18 294/77
4,665,908 A * 5/1987 Calkin ..... A61F 5/05883 128/870
4,841,961 A * 6/1989 Burlage ..... A61F 5/3776 128/876

(Continued)

FOREIGN PATENT DOCUMENTS

TW M567626 10/2018

*Primary Examiner* — Peter M. Cuomo
*Assistant Examiner* — Rahib T Zaman
(74) *Attorney, Agent, or Firm* — Muncy, Geissler, Olds & Lowe, P.C.

(57) ABSTRACT

A strap for carrying a human body comprises a plurality of longitudinal fixing straps arranged in parallel and at intervals, a plurality of transverse fixing straps arranged in parallel and at intervals and a plurality of securing pieces. Each longitudinal fixing strap overlaps with each transverse fixing strap, each securing piece respectively connects a longitudinal fixing straps and a transverse fixing straps, two ends of each longitudinal fixing strap are adjustably connected to form a loop, and two ends of each transverse fixing strap adjustably connected to form a loop. The strap further comprises a bearing bed arranged between the longitudinal fixing straps, each transverse fixing strap is superposed on the bearing bed, one side of which is defined as a bearing surface, and the longitudinal fixing strap and the transverse fixing strap to form loops on the bearing surface.

4 Claims, 7 Drawing Sheets

(56) References Cited

U.S. PATENT DOCUMENTS 5,050,254 A * 9/1991 Murphy ..... A61G 1/01 5/625
5,211,186 A * 5/1993 Shoemaker ..... A61F 5/05883 128/869
5,672,127 A * 9/1997 Danz ..... A63B 71/143 473/458
5,839,137 A * 11/1998 Butler ..... A61G 1/01 5/627
6,363,936 B1 * 4/2002 McCormick ..... A61G 1/044 128/870
6,834,651 B1 * 12/2004 Murdock ..... A47C 21/00 128/845
7,222,378 B2 * 5/2007 DuPree ..... A61G 1/01 5/625
7,302,723 B2 * 12/2007 Dean ..... A61G 1/01 128/875
8,281,430 B1 * 10/2012 Hough ..... A61G 7/1051 5/89.1
9,022,134 B2 * 5/2015 Calkin ..... B32B 23/02 169/49
9,283,129 B1 * 3/2016 Piter ..... A45F 4/06
9,480,613 B1 * 11/2016 Lackey ..... A61G 7/1023
10,292,878 B2 * 5/2019 Perez ..... A61G 1/044
10,363,177 B2 * 7/2019 Hobbs ..... A61G 1/013
2003/0070234 A1 * 4/2003 Smith ..... A61G 1/01 5/627
2006/0137097 A1 * 6/2006 Frost ..... A61G 7/1051 5/628
2009/0038076 A1 * 2/2009 Giduck ..... A61G 1/044 5/627
2010/0203780 A1 * 8/2010 Hobbs ..... A61G 1/013 441/80
2011/0119831 A1 * 5/2011 Rincon ..... A61G 1/013 5/627
2013/0227789 A1 * 9/2013 Olson ..... A61G 1/013 5/625
2016/0256340 A1 * 9/2016 Williams ..... A61G 7/1023
2016/0338894 A1 * 11/2016 Rodriguez ..... A61G 7/1063

* cited by examiner

STRAP FOR CARRYING HUMAN BODY

FIELD OF THE INVENTION

The invention relates to a strap for carrying a human body, in particular to a strap for carrying a human body which can be used anywhere without an auxiliary tool.

BACKGROUND OF THE INVENTION

In hospitals and nursing homes, many inpatients have difficulty in mobility because of inconvenience to walk, surgical recovery, psychological disease or disability. In general, it is commonly necessary that needs more than two people who unite their efforts to carry an inpatient in the emergency situations such as fire and earthquake. For this reason, how to quickly adopt a safe and effective carrying means in emergency evacuation situations has become a considerable concern for the carriers.

Therefore, the inventor of the present invention has developed a utility model patent with the Taiwan No. M567626 that relates to a reinforcing strap for mattress which can be arranged under a mattress. Also, in the emergency situations, a carrier is able to conveniently use the reinforcing strap for mattress to carry a patient or an old person along with the mattress to quickly escape from the accident site. However, the person to be carried may not lie in the bed in the right position as an emergency happens. Moreover, it is also possible that the person to be carried may slip and fell over in a bathroom or a kitchen due to a slippery floor, and then causes injury and clumsiness of movement. Under such circumstances, it is difficult for the above-mentioned utility model patent to provide effective assistance. Therefore, the present invention provides a more versatile rescue tool which is developed from the previous successful experience.

SUMMARY OF THE INVENTION

It is an object of the invention to solve the problem that the carrying strap in the prior art needs to be matched with a mattress, which features insufficient in versatility.

To achieve the above object, the present invention provides a strap for carrying a human body, which comprises a plurality of longitudinal fixing straps arranged in parallel and at intervals from each other, a plurality of transverse fixing straps arranged in parallel and at intervals from each other, and a plurality of securing pieces. Each of the plurality of longitudinal fixing straps overlaps with each of the plurality of transverse fixing straps, and each of the plurality of securing pieces respectively connects one of the plurality of longitudinal fixing straps and one of the plurality of transverse fixing straps. Further, two ends of each of the plurality of longitudinal fixing straps are adjustably connected to form a loop, and two ends of each of the plurality of transverse fixing straps are adjustably connected to form a loop. The strap for carrying a human body is characterized by comprising a bearing bed, wherein the bearing bed is arranged between the plurality of longitudinal fixing straps, each of the plurality of transverse fixing straps is superposed on the bearing bed. Furthermore, one side of the bearing bed is defined as a bearing surface, and each of the plurality of longitudinal fixing straps and each of the plurality of transverse fixing straps are connected to form a loop on a same side of the bearing surface.

Further, the strap for carrying a human body comprises a first lifting handle positioned between the plurality of longitudinal fixing straps, and the first lifting handle comprises a dragging part.

Further, the strap for carrying a human body comprises a second lifting handle positioned between the plurality of longitudinal fixing straps and spaced apart from the first lifting handle.

Further, the second lifting handle comprises a holding part, two movable rings movably connected with each of the plurality of longitudinal fixing straps respectively, and two limiting parts arranged along each of the plurality of longitudinal fixing straps and arranged at two ends of each of the two movable rings respectively.

Further, the strap for carrying a human body comprises a foot cover positioned between the plurality of longitudinal fixing straps.

Further, the foot cover includes a foot cover strap for a person being carried to pass through a foot, and an interior space between the foot cover strap and the bearing bed.

Further, the strap for carrying the human body comprises a hard plate combined with the bearing bed.

Therefore, compared with the prior art, the invention has the following beneficial effects: 1. by the arrangement of the bearing bed, the strap for carrying a human body is able to support a body of a person to be carried, so that the carriers enable of picking up the person to be carried at any place without matching with tools such as a mattress; and 2. by the arrangement of the holding part which is movable, the two movable rings, the limiting parts and the like, the carriers is able to completely pull up the strap for carrying a human body at a lower degree of constraint, such that the present invention can prevent the person being carried from discomfort with being strapped tightly by the strap during carrying.

DETAILED DESCRIPTION OF THE PREFERRED EMBODIMENTS

Figure 1:
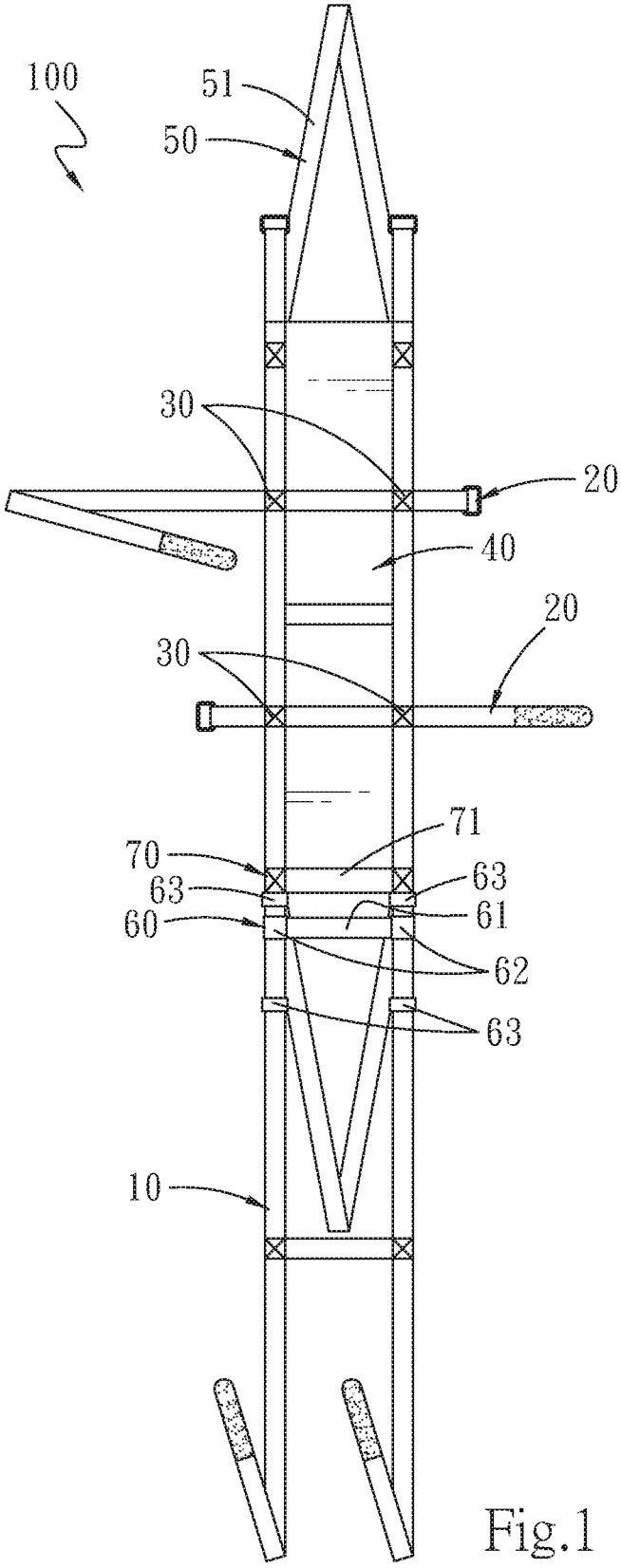
FIG. 1 is a plan view of the strap for carrying the human body of the present invention.
Figure 2:
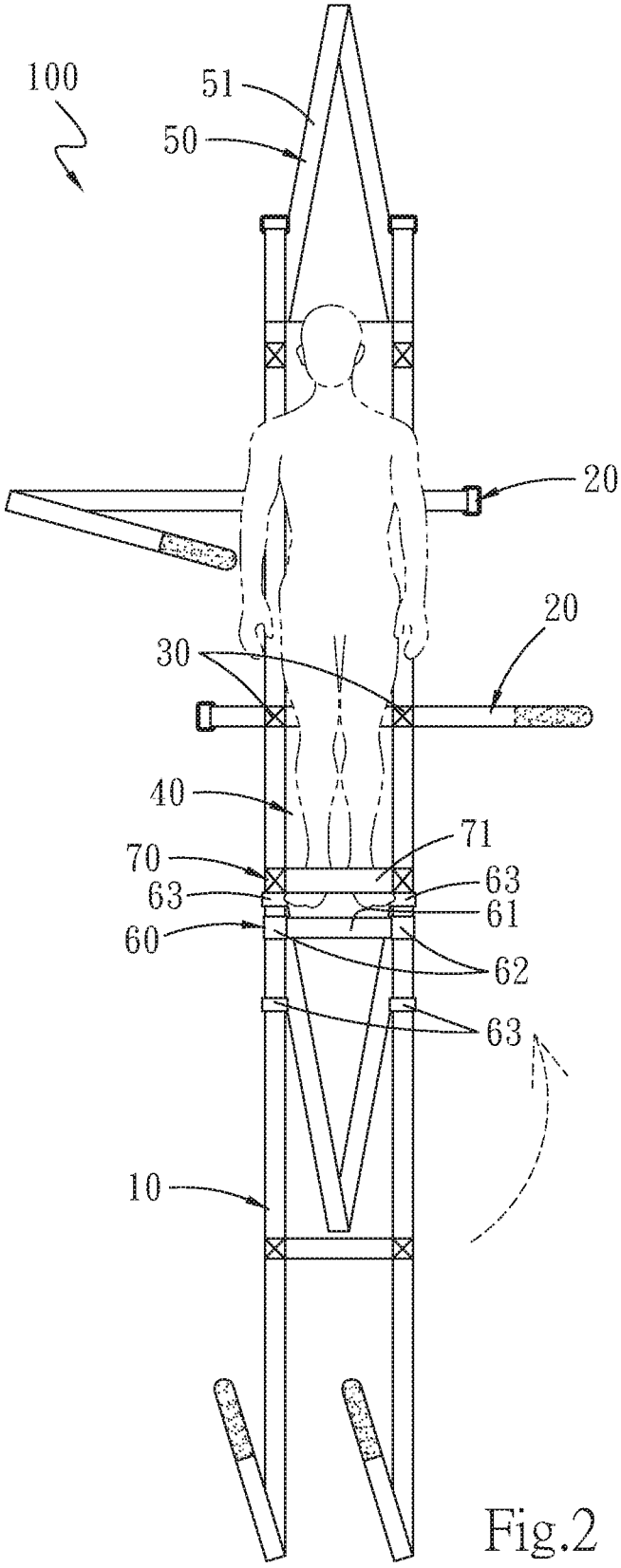
FIG. 2, FIG. 3, and FIG. 4 are schematic diagrams illustrating a person is constrained in the strap for carrying a human body of the present invention.
Figure 3:
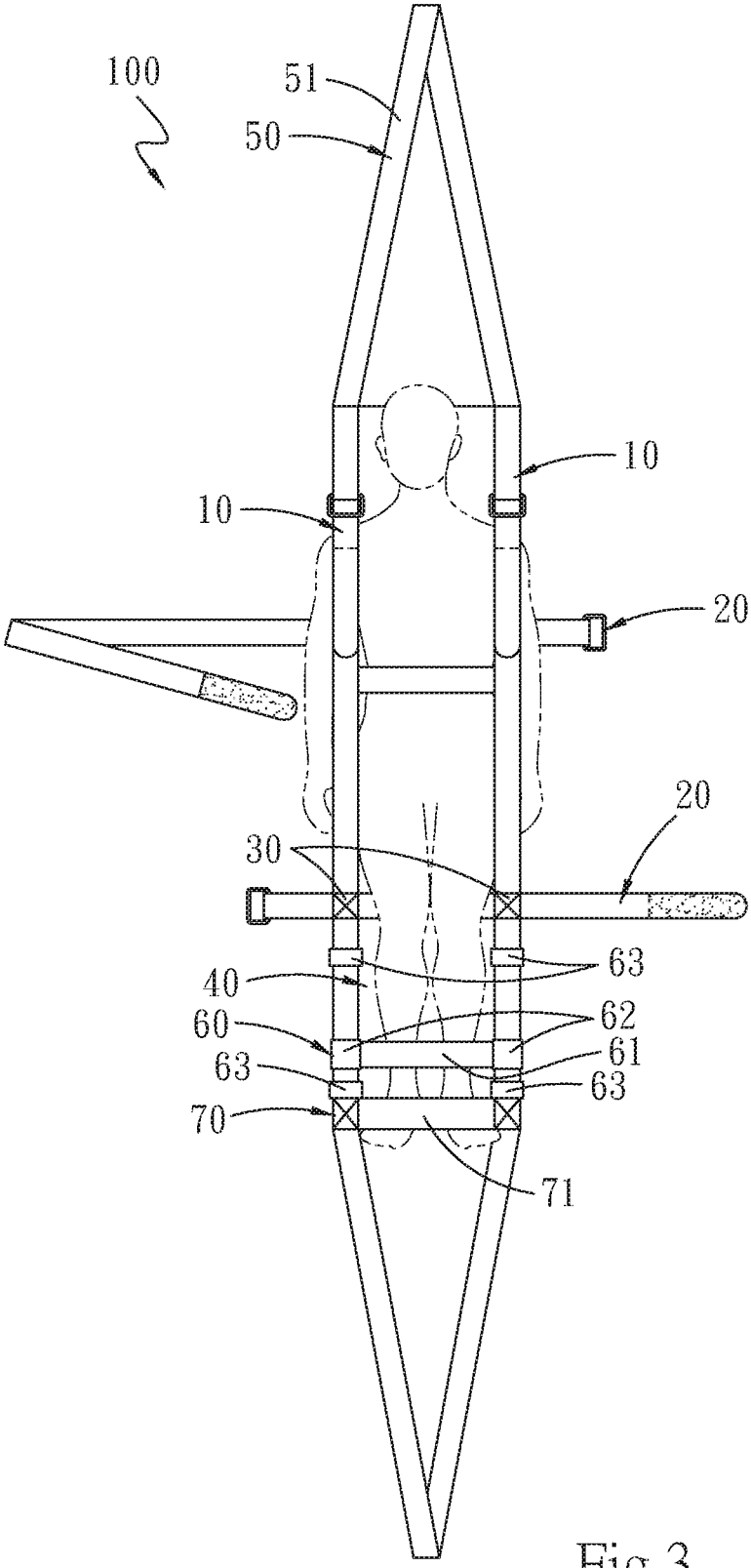
Figure 4:
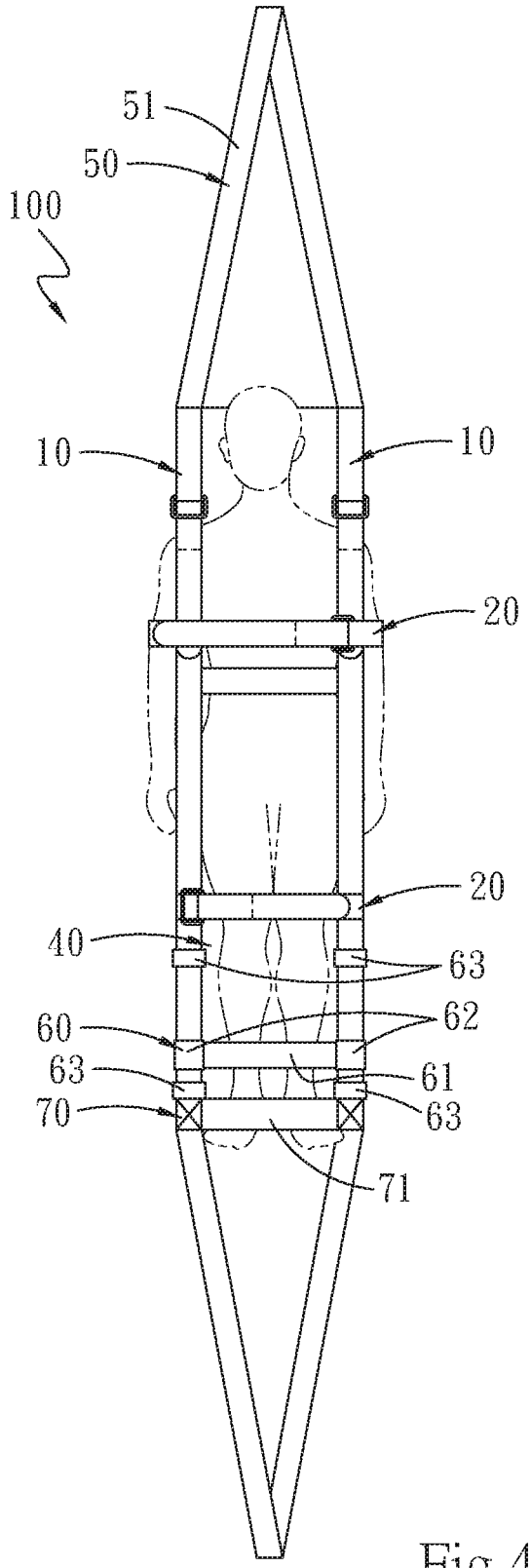
Figure 5:
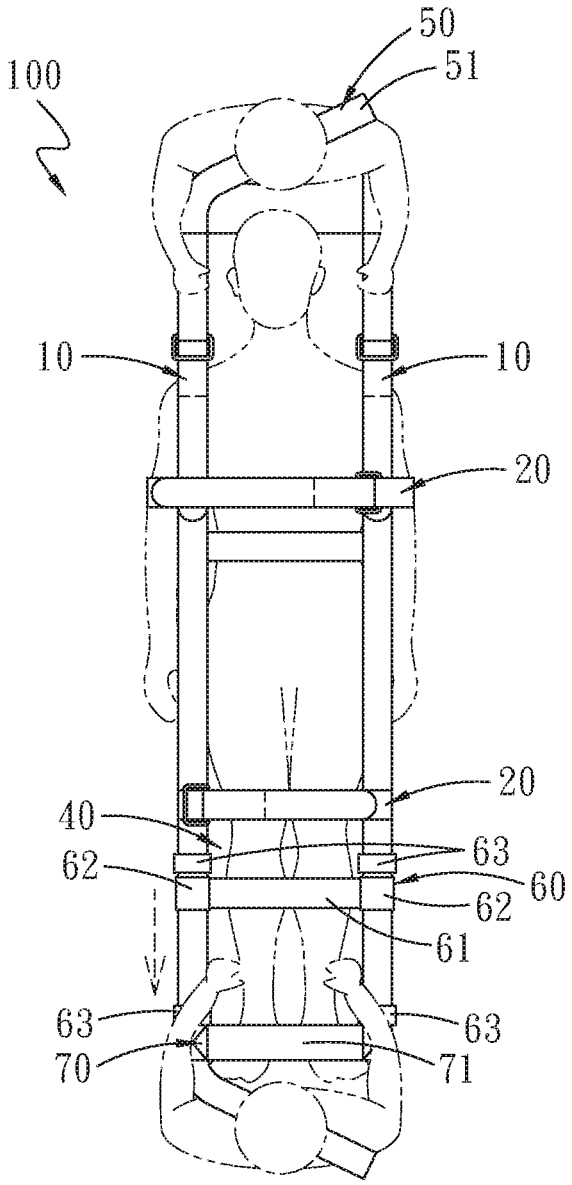
FIG. 5 is a schematic diagram illustrating a person being carried by the strap for carrying a human body of the present invention.

Please refer to FIG. 1, FIG. 2, FIG. 3, FIG. 4, and FIG. 5 for the technique of the present invention. The present invention provides a strap for carrying a human body 100, comprising a plurality of longitudinal fixing straps 10 arranged at interval from each other, a plurality of transverse fixing straps 20 arranged at interval from each other, and a plurality of securing pieces 30. In addition to carrying injured patient or old people in emergency situations and accidents, the strap for carrying a human body 100 provided by the invention is also used with corpse bags to facilitate carrying of remains. Each of the plurality of longitudinal fixing straps 10 perpendicularly overlaps with each of the plurality of transverse fixing straps 20 and both are connected by each of the plurality of securing pieces 30. Further, two ends of each of the plurality of longitudinal fixing straps 10 are adjustably connected to form a loop, and two ends of each of the plurality of transverse fixing straps 20 are adjustably connected to form a loop. In the present invention, the expression "adjustably connected to form a loop" means that the size of the loop formed by each of the plurality of longitudinal fixing straps 10 and each of the plurality of transverse fixing straps 20 is able to be adjusted according to the size of the person to be carried, thereby achieving the purpose of adjusting the tightness degree of each of the plurality of longitudinal fixing straps 10 and each of the plurality of transverse fixing straps 20 when the person to be carried is bound.

In the present embodiment, each of the plurality of longitudinal fixing straps 10 and each of the plurality of transverse fixing straps 20 may be made of nylon, cotton or blended fibers. Each of the plurality of securing pieces 30 may be a sewing thread sewn to each of the plurality of longitudinal fixing straps 10 and each of the plurality of transverse fixing straps 20. Each of the plurality of longitudinal fixing straps 10 disposes corresponding to the length of a human body, and each of the plurality of transverse fixing straps 20 disposed corresponding to the width of a human body. Each of the plurality of longitudinal fixing straps 10 and each of the plurality of transverse fixing straps 20 forms a loop space where a human body is constrained.

More specifically, the strap for carrying a human body 100 includes a bearing bed 40 arranged between the plurality of longitudinal fixing straps 10, each of the plurality of transverse fixing straps 20 is superposed on the bearing bed 40. Furthermore, one side of the bearing bed 40 is defined as a bearing surface, and each of the plurality of longitudinal fixing straps 10 and each of the plurality of transverse fixing straps 20 are connected to form loops on a same side of the bearing surface. In this embodiment, the bearing bed 40 may be made of canvas, plastic cloth or blended fiber. During carrying, a carrier is able to unfold the strap for carrying the human body 100, move the person to be carried to the bearing bed 40, and then fasten each of the plurality of longitudinal fixing straps 10 and each of the plurality of transverse fixing straps 20 to form a loop, so that the body of the person to be carried is firmly constrained in the bearing bed 40. And then, one end of the bearing bed 40, which is the same side of the head of the person to be carried, is lifted and dragged to move. Thus, the purpose of quick and laborsaving carrying is achieved in the present invention.

In addition, the strap for carrying a human body 100 further includes a first lifting handle 50 arranged between the plurality of longitudinal fixing straps 10, and the first lifting handle 50 includes a dragging part 51 for a carrier to carry on a shoulder of the carrier. The dragging part 51 is preferably arranged to have a length that is able to be around an upper torso of the carrier, thereby assisting the carrier to exert force during carrying. Moreover, the strap for carrying a human body 100 further includes a second lifting handle 60 arranged between the plurality of longitudinal fixing straps 10 and spaced apart from the first lifting handle 50 so as to be dragged by a carrier from the other end.

Figure 6:
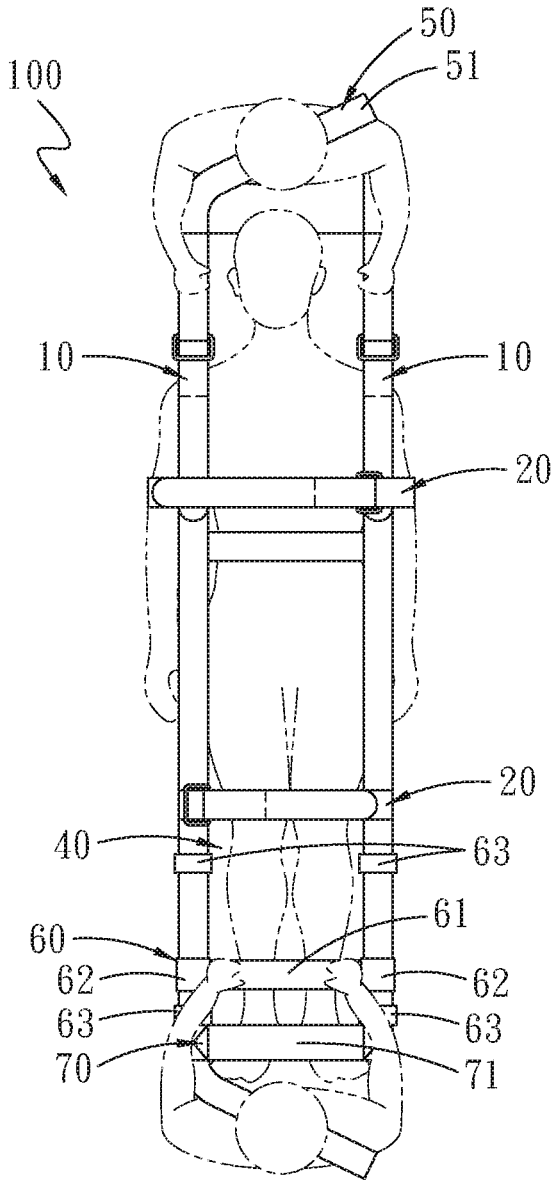
FIG. 6 is a schematic diagram of the second lifting handle of the present invention while using.

In the present embodiment, a preset position of the second lifting handle 60 is at the foot of the person being carried. Considering when the carrier need to lift feet of the person being carried, a fixed length of the handle may tightly strap the feet of the person being carried and cause discomfort, with reference to FIG. 6, the second lifting handle 60 includes a holding part 61, two movable rings 62, and two limiting parts 63. The holding part 61 is for the carrier to grasp by hand, the two movable rings 62 are movably connected to each of the plurality of longitudinal fixing straps 10, and the two limiting parts 63 are arranged along each of the plurality of longitudinal fixing straps 10 and arranged at two ends of each of the two movable rings 62. Therefore, when a carrier grasps the holding part 61 and lifts the foot of the person being carried, the holding part 61 has a certain degree of movable space. Thus, the present invention is able to avoid the problem that the person being carried being tightened by the holding part 61 since the person being carried has bulky body.

Figure 7:
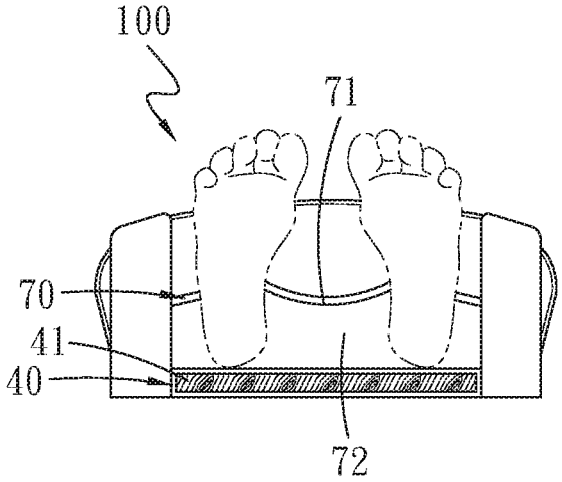
FIG. 7 is a schematic plan view of another embodiment of the present invention.

With reference to FIG. 7, in another embodiment, the strap for carrying a human body 100 further includes a hard plate 41 combined with the bearing bed 40. In this embodiment, the bearing bed 40 has a hollow interior for the hard plate 41 to pass through and combine with the bearing bed 40, thereby providing a support force of the bearing bed 40 to adapt to different emergency situations. In addition, the strap for carrying a human body 100 further comprises a foot cover 70 between the plurality of longitudinal fixing straps 10, wherein the foot cover 70 comprises a foot cover strap 71 for the feet of the person being carried to pass through, and an interior space 72 between the foot cover strap 71 and the bearing bed 40. During carrying, the feet of the person being carried may be passed through the interior space 72 to avoid slipping off.

In view of the above, the strap for carrying a human body 100 according to the present invention can surely support the body of a person to be carried by the bearing bed 40, so that carriers enable of picking up a person to be carried by the strap for carrying a human body 100 at any place without matching with tools such as a mattress. In addition, by the arrangement of the holding part 61 which is movable, the movable rings 62, the limiting parts 63 and the like, the carrier is able to prevent the feet of the person being carried from being strapped tightly by the strap for carrying a human body 100. Thus, the present invention has the beneficial effect of reducing discomfort.

What is claimed is:

1. A strap for carrying a human body, comprising:

a plurality of longitudinal fixing straps arranged in parallel and at intervals from each other, a plurality of transverse fixing straps and a plurality of securing pieces, each of the plurality of longitudinal fixing straps overlapping with each of the plurality of transverse fixing straps, each of the plurality of securing pieces respectively connecting one of the plurality of longitudinal fixing straps and one of the plurality of transverse fixing straps, two ends of each of the plurality of longitudinal fixing straps being adjustably connected to form a loop, and two ends of each of the plurality of transverse fixing straps being also adjustably connected to form a loop;

a bearing bed, arranged between the plurality of longitudinal fixing straps, each of the plurality of transverse fixing straps being superposed on the bearing bed, one side of the bearing bed being defined as a bearing surface, and each of the plurality of longitudinal fixing straps and each of the plurality of transverse fixing straps being connected to form a loop on a same side of the bearing surface;

a first lifting handle, positioned between the plurality of longitudinal fixing straps, the first lifting handle comprising a dragging part; and a second lifting handle, positioned between the plurality of longitudinal fixing straps and spaced apart from the first lifting handle, wherein the second lifting handle comprises a holding part, two movable rings movably connected to each of the plurality of longitudinal fixing straps respectively, and two limiting parts arranged along each of the plurality of longitudinal fixing straps and arranged at two ends of each of the two movable rings respectively.

2. The strap for carrying a human body according to claim 1, further comprising a foot cover arranged between the plurality of longitudinal fixing straps.

3. The strap for carrying a human body according to claim 2, wherein the foot cover includes a foot cover strap for a person being carried to pass through a foot, and an interior space between the foot cover strap and the bearing bed.

4. The strap for carrying a human body according to claim 1, further comprising a hard plate combined with the bearing bed.

* * * * *